US009812771B2

(12) United States Patent
Sung et al.

(10) Patent No.: US 9,812,771 B2
(45) Date of Patent: Nov. 7, 2017

(54) ANTENNA APPARATUS FOR MOBILE TERMINAL

(71) Applicant: Samsung Electronics Co., Ltd., Gyeonggi-do (KR)

(72) Inventors: Sang-Bong Sung, Gyeonggi-do (KR); Hyeon-Uk Kang, Seoul (KR); Kyoung-Mok Kim, Gyeonggi-do (KR); Seung-Hwan Kim, Seoul (KR); Jae-Ho Lee, Gyeonggi-do (KR)

(73) Assignee: Samsung Electronics Co., Ltd., Yeongtong-gu, Suwon-si, Gyeonggi-do (KR)

( * ) Notice: Subject to any disclaimer, the term of this patent is extended or adjusted under 35 U.S.C. 154(b) by 189 days.

(21) Appl. No.: 13/786,705

(22) Filed: Mar. 6, 2013

(65) Prior Publication Data

US 2013/0241795 A1 Sep. 19, 2013

(30) Foreign Application Priority Data

Mar. 19, 2012 (KR) ..... 10-2012-0027701

(51) Int. Cl.
*H01Q 1/50* (2006.01)
*H01Q 1/27* (2006.01)
*H01Q 9/42* (2006.01)

(52) U.S. Cl.
CPC ..... *H01Q 1/50* (2013.01); *H01Q 1/273* (2013.01); *H01Q 9/42* (2013.01)

(58) Field of Classification Search
CPC .. H01Q 1/22; H01Q 1/27; H01Q 1/38; H01Q 1/50; H01Q 9/42; H01Q 1/273
See application file for complete search history.

(56) References Cited

U.S. PATENT DOCUMENTS 5,128,686 A * 7/1992 Tan et al. ..... 343/718
5,189,431 A * 2/1993 Marinelli ..... 343/718
(Continued)

FOREIGN PATENT DOCUMENTS

CN 1822435 A 8/2006
CN 1977422 A 6/2007
(Continued)

OTHER PUBLICATIONS

Chinese Search Report; dated Mar. 14, 2017.
Chinese Search Report dated Jul. 21, 2016.
Chinese Search Report dated Aug. 31, 2017.

*Primary Examiner* — Jessica Han
*Assistant Examiner* — Noel Maldonado
(74) *Attorney, Agent, or Firm* — Cha & Reiter, LLC.

(57) ABSTRACT

A mobile terminal with an antenna apparatus is provided. The mobile terminal in one embodiment includes an antenna radiator disposed at a first end of the mobile terminal; at least one antenna modifying element disposed at a second, opposing end of the mobile terminal; and a coupling unit for fastening the first and second ends and electrically connecting the at least one antenna modifying element with the antenna device when the first and second ends are fastened. In another embodiment, a deformation detector detects at least one deformation of the mobile terminal, an antenna matching unit is electrically connectable to the first antenna radiator; and a controller is coupled to the deformation detector, for controlling an electrical connection between the antenna matching unit and the first antenna radiator when the at least one deformation is detected. The antenna matching unit may include a second antenna radiator.

7 Claims, 15 Drawing Sheets

(56) References Cited

U.S. PATENT DOCUMENTS

| | | | | |
|---|---|---|---|---|
| 5,886,669 | A * | 3/1999 | Kita | H01Q 1/273 343/700 MS |
| 6,862,432 | B1 * | 3/2005 | Kim | H04B 1/18 343/860 |
| 7,626,554 | B2 | 12/2009 | Mashima et al. | |
| 7,701,397 | B2 | 4/2010 | Mori et al. | |
| 7,999,749 | B2 * | 8/2011 | Ying | H01Q 1/243 343/700 MS |
| 2003/0169207 | A1 * | 9/2003 | Beigel | 343/718 |
| 2004/0008191 | A1 * | 1/2004 | Poupyrev et al. | 345/184 |
| 2006/0092081 | A1 * | 5/2006 | Kanazawa | H01Q 1/243 343/702 |
| 2006/0142075 | A1 | 6/2006 | Jang et al. | |
| 2008/0106477 | A1 * | 5/2008 | Mashima | H01Q 1/243 343/702 |
| 2008/0158795 | A1 | 7/2008 | Aoki et al. | |
| 2009/0147973 | A1 * | 6/2009 | Gitzinger | G06F 3/016 381/190 |
| 2011/0095975 | A1 * | 4/2011 | Hwang | G06F 1/1626 345/156 |
| 2011/0227822 | A1 * | 9/2011 | Shai | 345/156 |
| 2013/0127606 | A1 * | 5/2013 | Chang | G09G 3/006 340/384.7 |

FOREIGN PATENT DOCUMENTS

| | | | |
|---|---|---|---|
| CN | 101020095 | A | 8/2007 |
| CN | 101573879 | A | 11/2009 |
| CN | 102055821 | A | 5/2011 |
| KR | 10-2010-0075005 | A | 7/2010 |

* cited by examiner

S11 SWR 1.000/ Ref 1.000

| | | |
|---|---|---|
| 1 | 824.00000 MHz | 2.2517 |
| 2 | 894.00000 MHz | 2.2277 |
| 3 | 960.00000 MHz | 2.4972 |
| 4 | 1.7100000 GHz | 2.8153 |
| 5 | 1.8800000 GHz | 2.2299 |
| 6 | 1.9900000 GHz | 2.9103 |
| 7 | 2.1700000 GHz | 2.2709 |

S11 SWR 1.000/ Ref 1.000

| | | |
|---|---|---|
| 1 | 824.00000 MHz | 3.2109 |
| 2 | 894.00000 MHz | 1.5812 |
| 3 | 960.00000 MHz | 1.6168 |
| 4 | 1.7100000 GHz | 2.0958 |
| 5 | 1.8800000 GHz | 1.7434 |
| 6 | 1.9900000 GHz | 2.4141 |
| 7 | 2.1700000 GHz | 3.0549 |

ANTENNA APPARATUS FOR MOBILE TERMINAL

CLAIM OF PRIORITY

This application claims the benefit under 35 U.S.C. §119 (a) of a Korean patent application filed in the Korean Intellectual Property Office on Mar. 19, 2012 and assigned Serial No. 10-2012-0027701, the entire disclosure of which is hereby incorporated by reference.

BACKGROUND

1. Technical Field

The present disclosure relates generally to an antenna apparatus of a mobile terminal.

2. Description of the Related Art

Recently, interest has grown in a mobile terminal that incorporates a flexible display. Mobile terminals with flexible displays represent a new class of terminals, which have heretofore been limited to flat, rigid devices. For example, new fields such as wearable electronics, flexible electronic books that can replace publication such as magazines, and subminiature personal computers (PCs) that can be carried by folding or rolling a display, are emerging as utilization fields for flexible displays. In the meantime, technological advances in mobile communications, with new protocols such as 4G (LTE) and 5G, are continuing.

SUMMARY

An aspect of the present invention is to provide an antenna apparatus for a mobile terminal that applies a flexible display.

Another aspect of the present invention is to provide a mobile terminal that changes a configuration of an antenna apparatus depending on deformation of the mobile terminal, for example, rolling, extension, shrinkage, warping, folding, twisting, bending, unfolding.

Still another aspect of the present invention is to provide an antenna apparatus of a mobile terminal that changes configuration to achieve a desired antenna performance when one end of the mobile terminal is fastened to an opposite end in a folded, bent or rolled state In accordance with an aspect of the present invention, a mobile terminal including an antenna apparatus is provided. The mobile terminal includes a first antenna radiator; a deformation detector which detects at least one deformation of the mobile terminal; and an antenna matching unit electrically connectable to the first antenna radiator. A controller is coupled to the deformation detector, for controlling an electrical connection between the antenna matching unit and the first antenna radiator when the at least one deformation is detected. The antenna matching unit comprises at least one of a second antenna radiator, a grounding surface and a matching circuit.

In accordance with another aspect, a mobile terminal having an antenna apparatus includes an antenna radiator; at least one antenna modifying element selectively connectable to the antenna radiator; and a deformation detection means for detecting at least one deformation of the mobile terminal. A control means, coupled to the deformation detection means, is provided for releasing or closing electrical connection between the antenna radiator and the at least one antenna modifying element according to the deformation detection.

In yet another aspect, a mobile terminal includes an antenna radiator; a plurality of antenna modifying elements electrically connectable to the antenna radiator; a deformation detection means for obtaining deformation information of the mobile terminal; and a control means for selecting at least one of the plurality of antenna modifying elements based on the deformation information of the mobile terminal obtained by the deformation detection means, and electrically connecting the at least one selected antenna modifying element to the antenna radiator.

In still another aspect, a mobile terminal includes an antenna radiator disposed at a first end of the mobile terminal; at least one antenna modifying element disposed at a second, opposing end of the mobile terminal; and a coupling means for fastening the first and second ends and electrically connecting the at least one antenna modifying element with the antenna device when the first and second ends are fastened.

Other aspects, advantages and salient features of the invention will become apparent to those skilled in the art from the following detailed description, which, taken in conjunction with the annexed drawings, discloses exemplary embodiments of the invention.

BRIEF DESCRIPTION OF THE DRAWINGS

The above and other aspects, features and advantages of certain exemplary embodiments of the present invention will be more apparent from the following description taken in conjunction with the accompanying drawings in which.

Throughout the drawings, like reference numerals will be understood to refer to like parts, components and structures.

DETAILED DESCRIPTION OF EXEMPLARY EMBODIMENTS

The following description with reference to the accompanying drawings is provided to assist in a comprehensive understanding of exemplary embodiments of the invention as defined by the claims and their equivalents. It includes various specific details to assist in that understanding but these are to be regarded as merely exemplary. Accordingly, those of ordinary skill in the art will recognize that various changes and modifications of the embodiments described herein can be made without departing from the scope and spirit of the invention. Also, descriptions of well-known functions and constructions are omitted for clarity and conciseness.

The terms and words used in the following description and claims are not limited to the bibliographical meanings, but, are merely used by the inventor to enable a clear and consistent understanding of the invention. Accordingly, it should be apparent to those skilled in the art that the following description of exemplary embodiments of the present invention are provided for illustration purpose only and not for the purpose of limiting the invention as defined by the appended claims and their equivalents.

Exemplary embodiments of the present invention provide a changeable antenna apparatus for a flexible-display mobile terminal. The mobile terminal allows deformation such as rolling, unrolling, extension, shrinkage, warping, folding, twisting, bending, unfolding, etc. Particularly, the mobile terminal has a flexible display as a major surface of the mobile terminal, thus, the flexible display deforms along with the mobile terminal. The antenna apparatus changes configuration depending on the mobile terminal deformation, in order to maintain a desired antenna performance. For example, the antenna apparatus according to an exemplary embodiment changes its configuration depending on an amount of bending, curvature or the detection of a rolled state of the mobile terminal.

Figure 1:
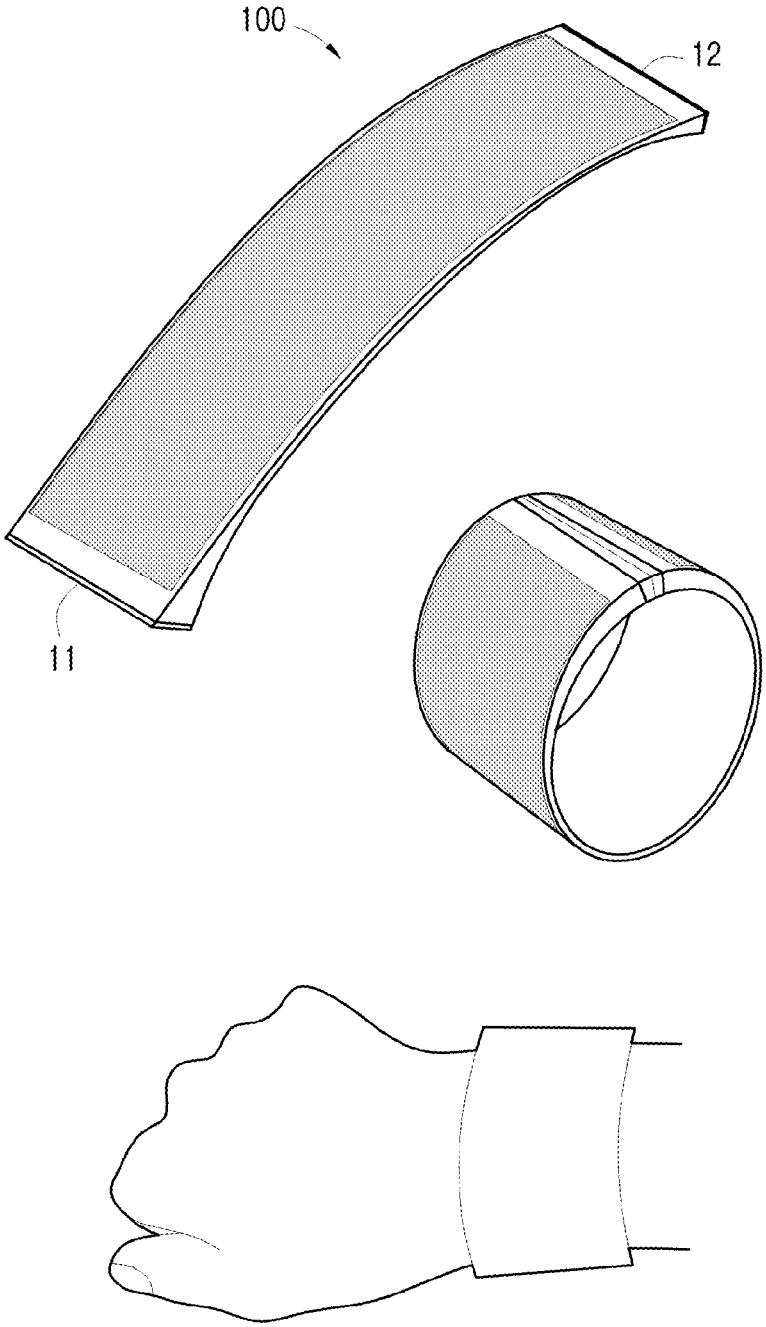
FIG. 1 shows perspective views illustrating different bending states of a flexible mobile terminal according to an exemplary embodiment of the present invention.

FIG. 1 shows perspective views illustrating different bending states of a flexible mobile terminal according to an exemplary embodiment of the present invention. The mobile terminal 100 includes a flexible display and may bend via manual application of force. One end 11 may be fastened to the other end 12 via a suitable coupling means. According to this configuration, the mobile terminal 100 may be worn on a user's wrist. The mobile terminal 100 includes an antenna apparatus for wireless communication according to the present invention.

FIGS. 2 through 5 are views illustrating respective configurations for an antenna deployable within either end of the flexible mobile terminal. Any of these example configurations may be used as a first or second antenna as part of a changeable antenna apparatus according to exemplary embodiments of the present invention, such as those described in connection with FIGS. 6 through 14.

Figure 2:
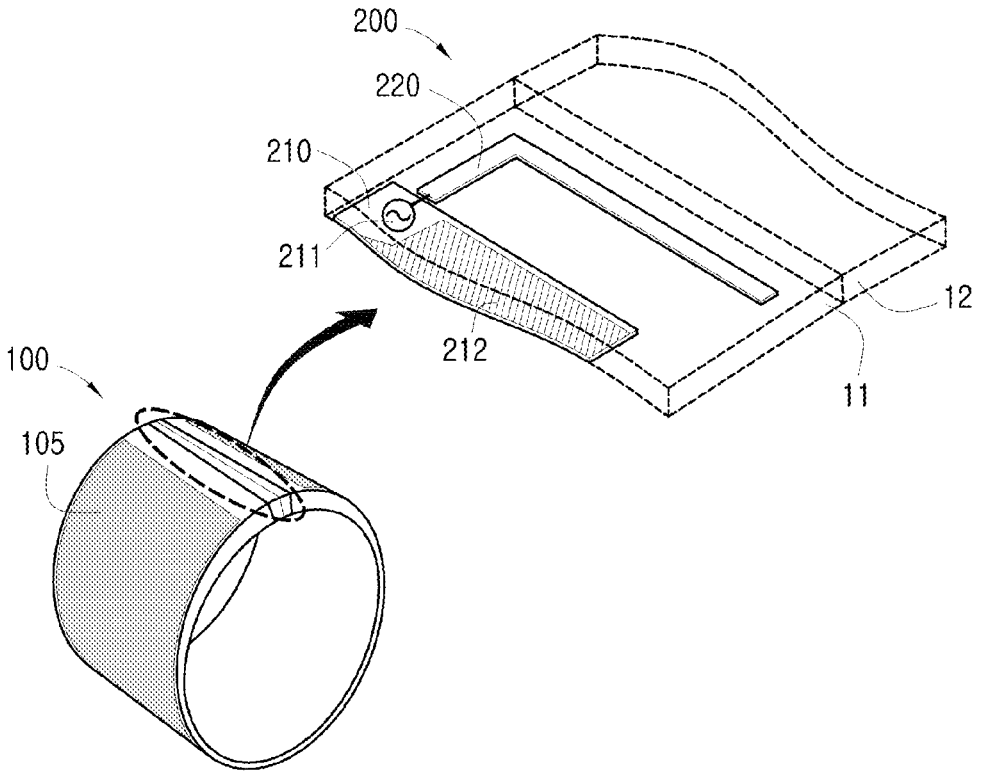
FIG. 2, FIG. 3, FIG. 4 and FIG. 5 are views illustrating respective configurations for an antenna deployable within either end of the flexible mobile terminal of FIG. 1.

Referring now to FIG. 2, an antenna 200 is an L-shaped monopole having an antenna radiator 220 and an input feed portion electrically connected to an RF feed port 211 of a printed circuit board (PCB) 210 (also referred to as a "mainboard"). Herein, when an antenna (or antenna apparatus or radiator) is said to be connected to an RF feed port, this signifies that RF signal power flowing from the feed port is transmitted by the antenna, and/or RF signal power received by the antenna is routed to the RF feed port.

The mainboard 210 is a substrate containing basic circuits and parts thereon, serves as an element for setting an execution environment of the mobile terminal, maintains information thereof, allows the mobile terminal to stably operate, and smoothes data input/output exchange of all units of the mobile terminal. The antenna 200 connects to the RF feed port 211 of the mainboard 210. In this embodiment, the antenna radiator can be embodied as a rigid plate suitably supported (e.g., fastened or bonded) within the end 11. The mainboard 210 includes a grounding surface 212 but no points of the antenna radiator 220 are connected thereto in this example.

FIGS. 2 through 5 are presented to illustrate example antenna configurations deployable within the end 11, thus no antenna elements are shown within the interior of the end 12, for simplicity of explanation. As will be described below, however, antenna modifying elements are includable within the end 12 in accordance with embodiments of the invention.

As mentioned above, one end 11 can be manually fastened to the other end 12 of the mobile terminal 100. As illustrated in FIG. 2, the first antenna radiator 220 may be disposed at a position in the vicinity of the one end 11; this position is also in the vicinity of the other end 12 when the two ends are fastened. By disposing the first antenna radiator 220 near or within the end 11 and 12, electromagnetic interference with the flexible display 105 is reduced. However, it is also possible to for the antennas to be located away from the ends 11 and 12.

Figure 3:
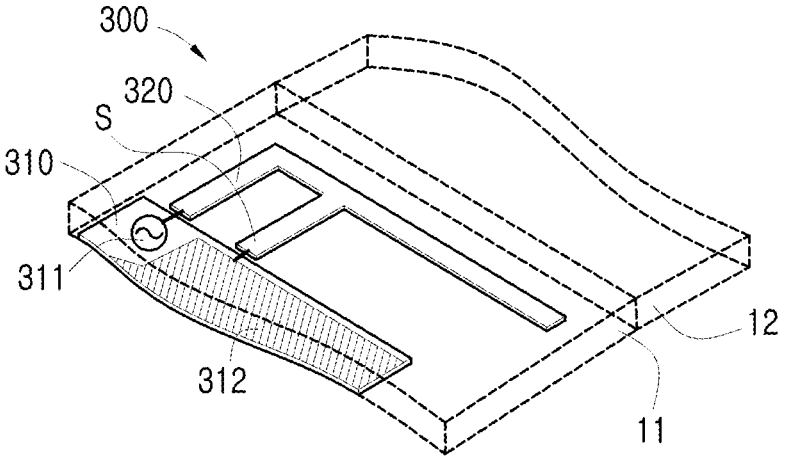

The first antenna radiator 220 may be applied as a monopole antenna as illustrated in FIG. 2, but is not limited thereto. FIG. 3 illustrates an embodiment of an antenna 300 configured as an inverted F antenna (IFA). Antenna 300 includes a radiator portion 320 having a shorting section S connected to a grounding surface 212 of a PCB 210. An input end of antenna 300 is connected to an RF feed port 311.

Figure 4:
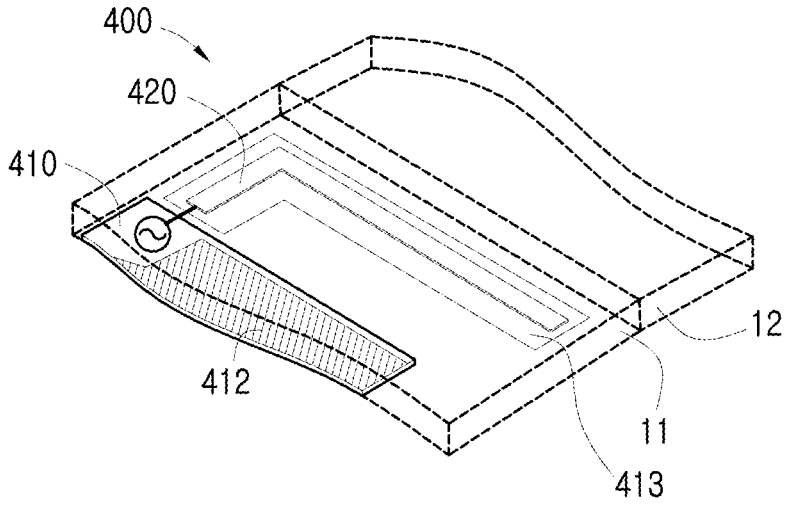

FIG. 4 is a perspective view of an L-shaped monopole antenna 400 similar to the antenna 200 of FIG. 2, but formed in a Flexible Printed Circuit Board (FPCB). Antenna 400 includes a first antenna radiator 420 formed within a FPCB 413, having an input end electrically connected to an RF feed port of a PCB 410. The FPCB 413 may be self-supporting, or supported within the end 11 by any suitable support means. Instead of the monopole, an IFA type antenna radiator can alternatively be formed within the FPCB 413.

Figure 5:
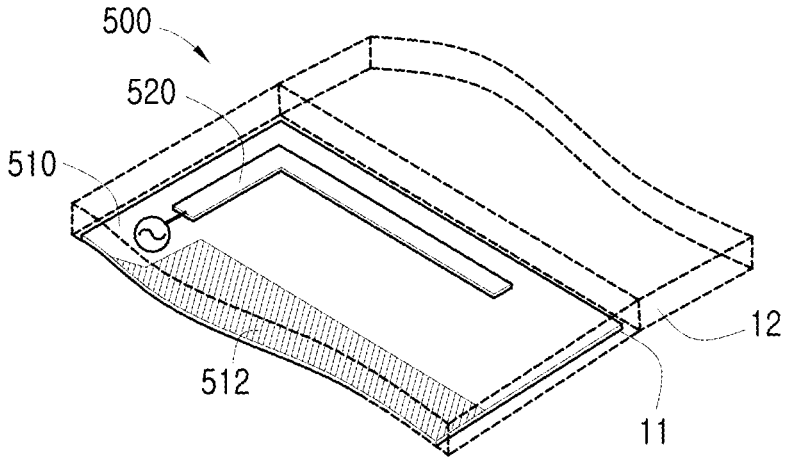

FIG. 5 is a perspective view of an L-shaped monopole antenna 500 similar to the antenna 200 of FIG. 2, except formed or placed as a conductive pattern on a top surface of a PCB 510. A first antenna radiator 520 connects to an RF feed port of the PCB 510. In an embodiment, the bottom surface of the PCB 510 in the region of the end 11 is a non-conductive surface. Alternatively, the bottom surface is a conductive reflective plane, such that the first antenna radiator 520 may be a microstrip antenna, e.g., a patch antenna. Instead of the monopole, an IFA antenna can be patterned on the PCB 510.

Figure 6A:
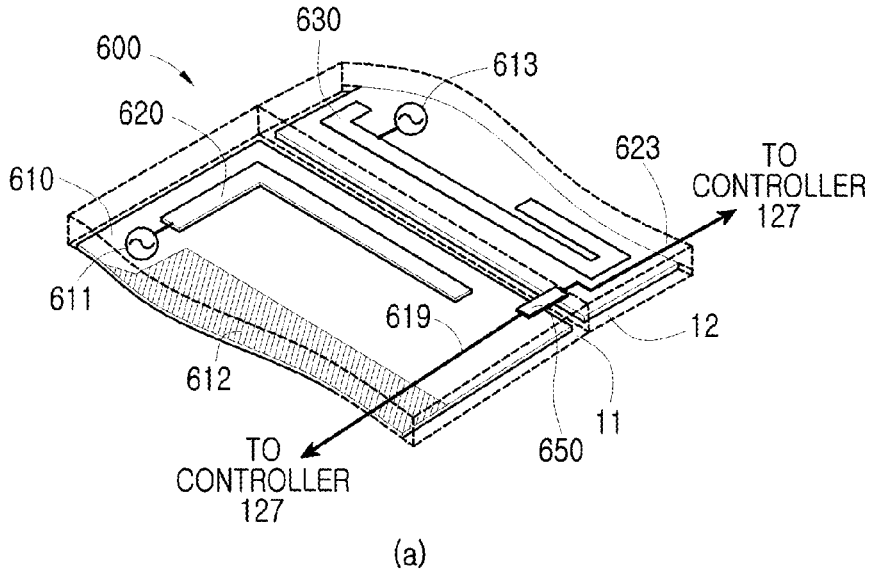
FIG. 6A is a perspective view illustrating a configuration of an antenna apparatus according to an exemplary embodiment of the present invention.
Figure 6A:
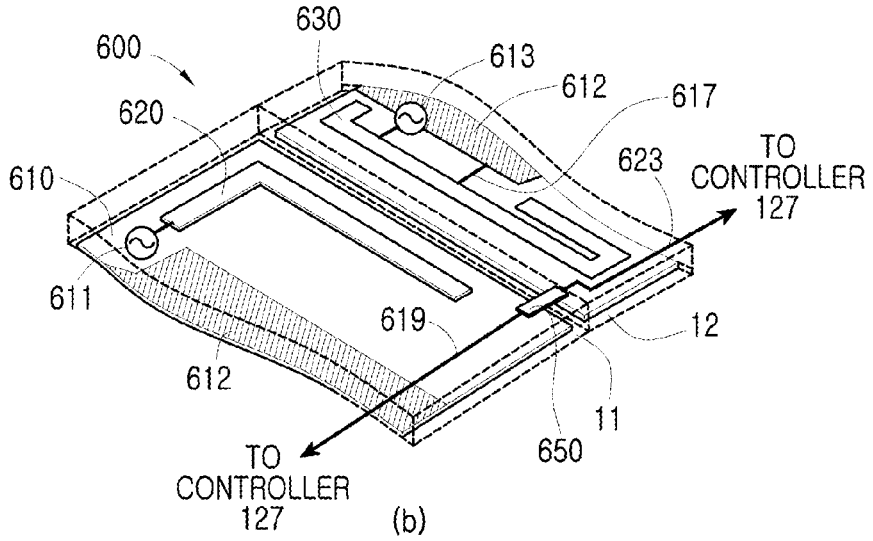

FIG. 6A is a perspective view illustrating configuration of an antenna apparatus, 600, according to an exemplary embodiment of the present invention. Antenna apparatus 600 includes a first antenna radiator 620 connected to an RF feed port 611 of a PCB 610, and a second antenna radiator 630 connected to an RF feed port 613 on an opposite end of the PCB 610, or on a different circuit board. In one implementation, only one of the antenna radiators 620, 630 is operated (excited) at any given time. Alternatively, both antenna radiators 620, 630 can be operated simultaneously as a two element array under certain conditions.

A controller 127 (shown and described below in connection with FIG. 6B) controls a switch 623 (shown in FIG. 6B) to select a communication operation that includes antenna radiator 620 and/or 630, thereby changing the operational configuration of the antenna apparatus 600. The controller may change the configuration of the antenna apparatus 600 depending on deformation of the mobile terminal 100, for example, rolling, unrolling, extension, shrinkage, warping, folding, twisting, bending, unfolding, etc. The antenna configuration is changed when deformation is detected in order to compensate for electromagnetic interference of the flexible display.

For example, when one end 11 and the other end 12 are detected as not fastened, the switch 623 may be controlled such that only the first radiator 620 is operated. When the ends 11 and 12 are detected to be fastened, the mobile terminal is considered to enter a rolled or bent state. In this state, the controller changes the antenna configuration by either switching a communication circuit connection from the first radiator 620 to the second radiator 630, or, splitting an RF signal between radiators 620 and 630 to form an operational array. As another alternative, the second radiator 630, or the array configuration, is used in the non-fastened state whereas only the first radiator 620 is used in the fastened state.

The antenna apparatus 600 includes a deformation detector 650 for detecting the deformation of the mobile terminal and informing the controller 127 of the same. Deformation detector 650 is electrically connected to controller 127 through lead 619 within the end 11, and through lead 623 within the other end 12 to complete a circuit path to the controller upon fastening of the two ends. The deformation detector 650 may be one of the following configurations: First, the deformation detector can include a male connector on one end of the mobile terminal, and a female connector on the other end of the mobile terminal. When the male and female connectors are electrically connected, the controller detects that the above-noted circuit path is closed, which indicates the rolled condition of the mobile terminal 100. Second, the deformation detector 650 includes a switch on one end 11 and a member on the other end 12 (or vice versa) which contacts the switch upon fastening of the two ends, thereby closing or opening the switch and turning the switch on or off, respectively. When the switch and the member are coupled to each other, a circuit path (including the deformation detector) to the controller is closed or opened), whereby the controller detects the bending of the mobile terminal. Third, the deformation detector can include a sensor on one end 11 and a member associated with the sensor on the other end 12. When the sensor reacts to the associated member, the deformation detector provides a signal to the controller indicative of the same, thus informing the controller of the bending state.

Also, in another exemplary embodiment, the deformation detector includes at least one sensor arranged on a flexible display to detect the deformation. For example, the at least one sensor measures a tension on a surface of flexible display, and the deformation detector may determine a type of deformation, such as rolling, unrolling, extension, shrinkage, warping, folding, twisting, bending and unfolding, from the measured tension.

The first antenna radiator 620 and the second antenna radiator 630 may have the same resonant frequency or different resonant frequencies. For example, in the case of different resonant frequencies, when a deformation condition is detected, the controller may simultaneously control a change in an operating frequency of the mobile terminal 100 and a switch in operation from the first to second antenna radiators.

Furthermore, the same type of antenna or different types of antennas may be applied for the first and second antenna radiators 620, 630. For example, as seen in view (a), different types of monopole antennas may be utilized for the two radiators. As seen in view (b), a monopole antenna type may be applied for the first antenna radiator 620, and an inverted F antenna type may be applied for the second antenna radiator 630. The inverted F antenna includes a ground connection 617 to the ground surface 612 of the PCB 610.

Figure 6B:
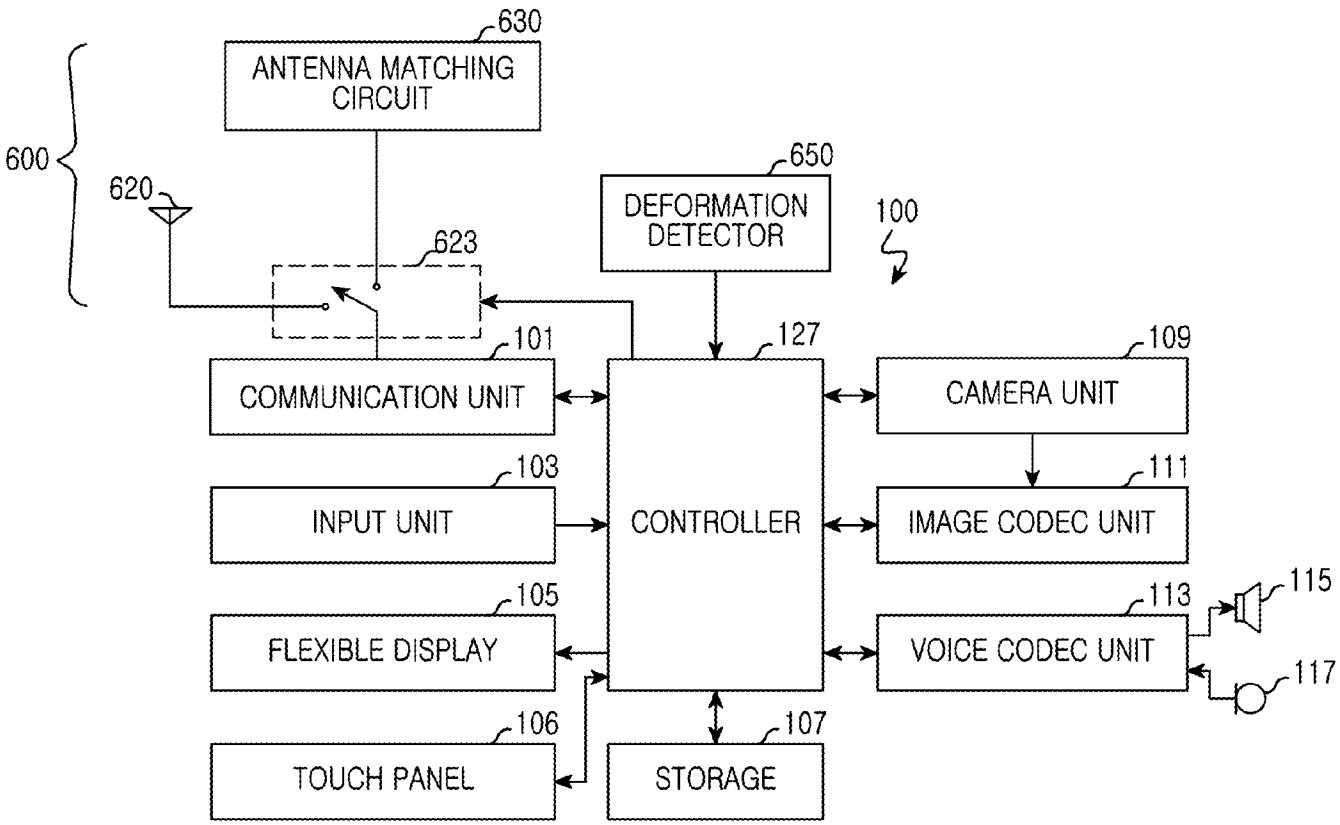
FIG. 6B is a block diagram illustrating a mobile terminal according to an exemplary embodiment of the present invention, which may include the antenna apparatus 600 shown in FIG. 6A.

FIG. 6B is a block diagram illustrating a mobile terminal 100 according to an exemplary embodiment of the present invention, which may include the antenna apparatus 600 shown in FIG. 6A, views (a) or (b). In the following description, the mobile terminal 100 can be configured as any one of a smart phone, a cell phone, a Personal Communication System (PCS) compatible terminal, a Personal Data Assistant (PDA), an International Mobile Communication-2000 (IMT-2000) terminal, a $4^{th}$ or $5^{th}$ generation broadband system terminal, etc. The following description is made using the general configuration of these mobile terminals.

As shown in FIG. 6B, the mobile terminal 100 includes a communication unit 101, an input unit 103, a flexible display 105, a touch panel 106, a storage 107, a camera unit 109, an image codec unit 111, a voice codec unit 113, a speaker 115, a microphone 117, the first antenna radiator 620, second antenna radiator 630, a switching unit 623, the deformation detector 650, and the controller 127. The antenna 600 comprises the first and second radiators 620 and 630. The mobile terminal 100 is deformable, for example, deformed by at least one of rolling, bending, extension, shrinkage, warping, folding, twisting, and unfolding.

The communication unit 101 provides a hardware or software environment for a wireless communication. For example, the communication unit 101 down-converts a Radio Frequency (RF) signal received via an antenna to provide the same to the controller 127, and up-converts a baseband signal from the controller 127 to transmit the same via the antenna 600. The controller 127 controls an overall operation of the mobile terminal 100. The input unit 103 has a plurality of keys and provides a key press signal corresponding to a key pressed by a user to the controller 127. The flexible display 105 outputs an image under control of the controller 127. The controller 127 demodulates image data via the image codec unit 111 to output the same to the flexible display 105. The touch panel 106 is attached to the flexible display 105 and enables a touch input. The storage 107 stores a program for controlling an overall operation of the mobile terminal 100 and stores various data input/output when a control operation of the mobile terminal 100 is performed. The camera unit 109 captures an image to generate image data and outputs the image data to the image codec unit 111. The image codec unit 111 modulates image data provided from the camera unit 109 to provide the same to the controller 127. Also, the image codec unit 111 demodulates image data provided from the controller 127 to provide the same via the flexible display 105. The voice codec unit 113 modulates voice data provided from the microphone 117 to provide the same to the controller 127. Also, the voice codec unit 113 demodulates voice data provided from the controller 127 to provide the same via the speaker 115.

The first or second antenna radiator 620 or 630 is selected for communication of RF signals based on the detection indication of the deformation detector 650. The switching unit 623 selectively connects or disconnects the first antenna radiator 620 or the second antenna radiator 630 to the communication unit 101 based on the deformation detection indication. In the example of FIG. 6A, when the ends 11 and 12 are detected to be unfastened, the controller 127 selects the first radiator 620, and when the ends 11 and 12 are detected as fastened, the mobile terminal 100 is detected to be in a deformed state, and the controller 127 switches communication operations to the second radiator 630 by controlling the switch 623. Although the switch 623 is shown in FIG. 6B as a single pole, double throw switch, in an alternative implementation, switch 623 has a position allowing the input signal to be split between two paths leading to radiators 620, 630. This allows the two radiators to be used as a two element antenna array under the control of controller 127, to compensate for electromagnetic interference of the flexible display 127 during the deformation condition in an alternative manner.

Figure 7:
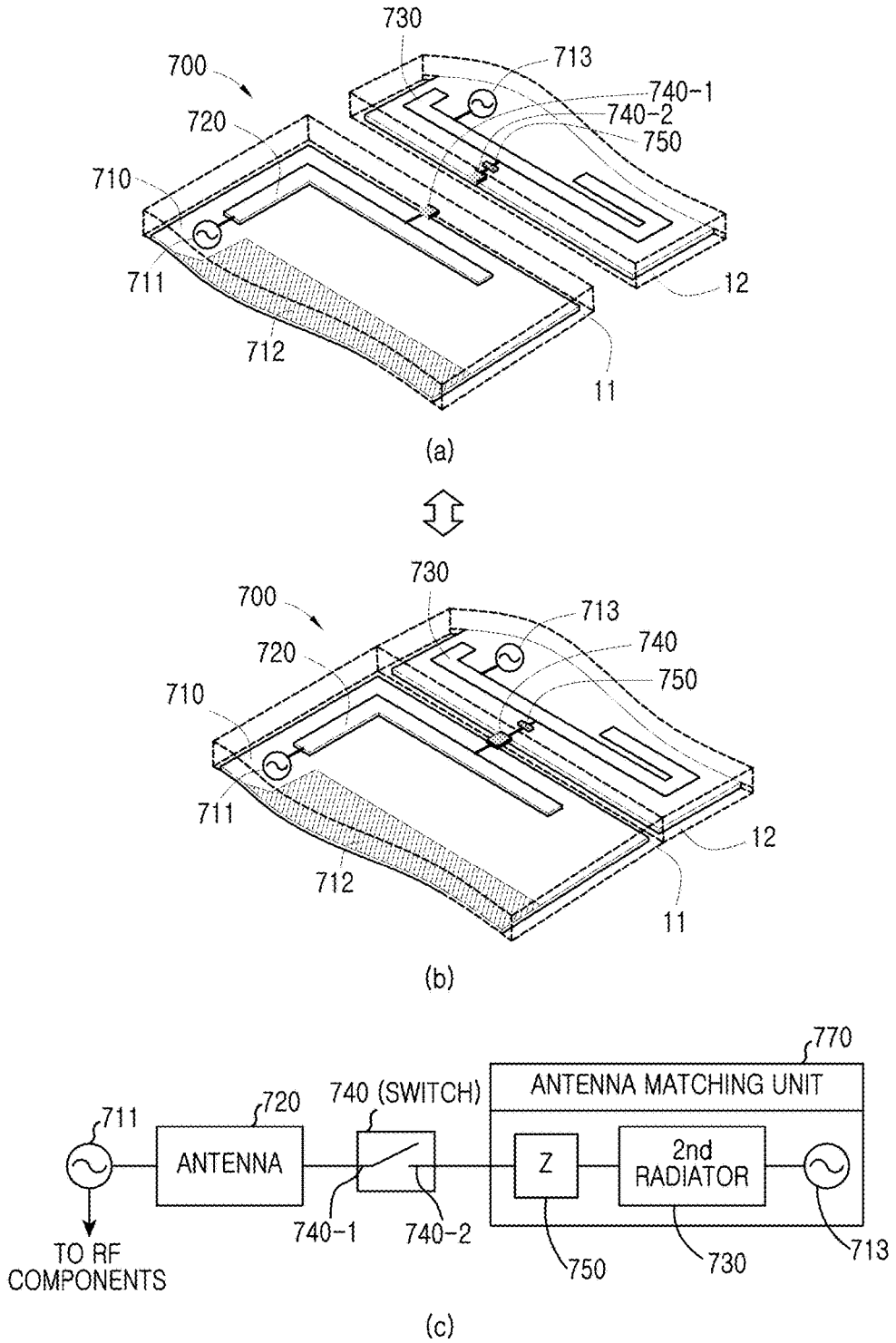
FIG. 7 is a perspective view illustrating the configuration of an antenna apparatus according to another exemplary embodiment of the present invention.

FIG. 7 is a perspective view illustrating the configuration of an antenna apparatus according to another exemplary embodiment of the present invention. The antenna apparatus 700 includes a first antenna radiator 720 within the first end 11 of the mobile terminal and a second antenna radiator 730 within the second end 11, where each radiator may be separately fed from a PCB (mainboard) 710 to resonate.

The mainboard 710 includes first and second RF feeding ports 711 and 713, which are electrically connected with input portions of the first and second antenna radiators 720 and 730, respectively. The first antenna radiator 720 and the second antenna radiator 730 are fed from the corresponding feeding ports 711 and 713, respectively, to resonate.

When the first and second ends 11, 12 of the mobile terminal are fastened, the first and second radiators 720 and 730 are electrically connected with each other. To realize this connection, the first antenna radiator 720 and the second antenna radiator 730 may be electrically connected with each other via a coupling unit 740, as shown in the view (b) depicting the fastened condition. For example, as seen in the unfastened condition view (a), the coupling unit 740 includes a male connector 740-1 electrically connected with the first antenna radiator 710 on its one end and a female connector 740-2 electrically connected with the second antenna radiator 730 on its other end.

Furthermore, the antenna apparatus 700 may further include an antenna matching device 750 interposed for connection between the first antenna radiator 720 and the second antenna radiator 730. The antenna matching device 750 may include a capacitor or an inductor, or a combination thereof. The antenna matching device 750 reduces interference between the two antenna radiators 720 and 730 or compensates for resonant frequencies that interfere and mismatch with each other. In the illustrated embodiment, the electrical connection between the two radiators 720, 730, and the matching device 750, are disposed in a central region of both radiators, but they may be offset from the center regions in alternative implementations.

The first antenna radiator 720 and the second antenna radiator 730 may be configured to have the same or different resonant frequencies. When the two radiators 720, 730 are designed with the same resonant frequencies, the RF communication signal handled by the first radiator 720 is split up between the two radiators and radiated by both radiators. In this case, the RF feed ports 711 and 713 are connected, such that the same signal is fed (on transmit) from the feed ports 711, 713 to the inputs of each antenna radiator. (Alternatively, similar to the configuration of the embodiment in FIG. 8 described below, when the radiators 720, 730 are designed with the same resonant frequency, the second radiator 730 is not separately connected to the RF feed port 713, and is just used as an extension of antenna radiator 720 when the two ends 11,12 are fastened. That is, in this alternative, the second radiator 730 is not used when the ends 11, 12 are unfastened.)

When the two radiators 720 and 730 are designed to resonate at different frequencies, such as at the centers of different RF communication bands, during transmit, different RF signals are fed from the RF feed ports 711 and 713 to the inputs of each radiator 720 and 730 (and on receive, different signals are received by each radiator and fed to the respective feed ports).

Whether the radiators 720 and 730 are designed for the same or different resonant frequencies, the matching device 750 in conjunction with the second radiator 730 (connected to RF port 713) together operate as an antenna matching unit 770 for the radiator 720 (refer to the schematic illustration (c)). That is, coupling unit 740 operates as a switch to connect and disconnect the antenna matching unit 770 to the first antenna radiator 720 when the ends 11, 12 are fastened and unfastened, respectively, to change the configuration of antenna 700. The second antenna radiator 730 and the matching circuit 750 each act as antenna modifying elements. No control by a controller of the mobile terminal 100 is necessary in this embodiment to implement the antenna configuration change.

It should be noted, that the first and second radiators 720, 730 are illustrated as located within the respective ends 11 and 12, but in alternative configurations, they may be located further back from the ends 11 and 12.

Figure 8:
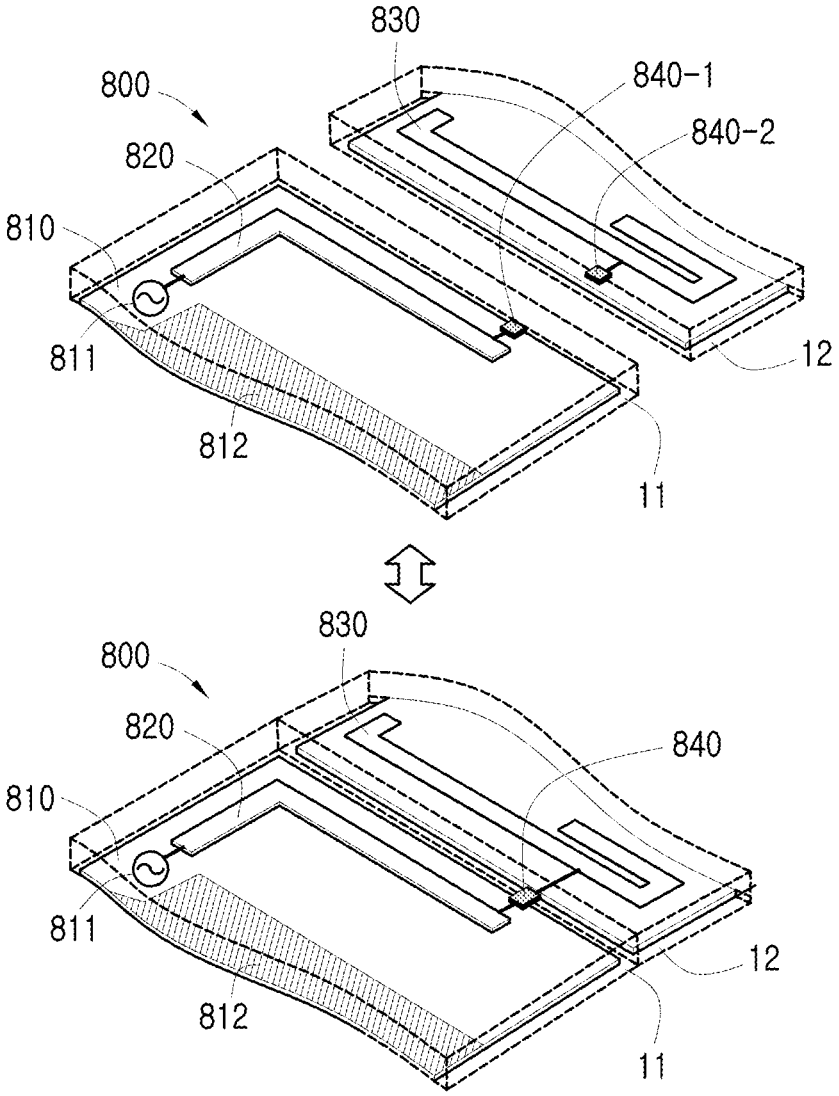
FIG. 8 is a view illustrating the configuration of an antenna apparatus according to another exemplary embodiment of the present invention.

FIG. 8 is a view illustrating the configuration of an antenna apparatus according to another exemplary embodiment, 800, of the present invention. The antenna apparatus 800 includes a mainboard 810 and a first antenna radiator 820 fed from the mainboard 810 to resonate. Furthermore, the antenna apparatus 800 includes a second antenna radiator 830 electrically connected with the first antenna radiator 820 in the case where one end 11 and the other end 12 of the mobile terminal are fastened. The second antenna radiator 830 cannot independently resonate in the case where the second antenna radiator 830 is not electrically connected with the first antenna radiator 820. The mainboard 810 includes a feeding portion 811. The feeding portion 811 and the first antenna radiator 820 are electrically connected with each other. The first antenna radiator 820 is fed from the feeding portion 811 to resonate. In the case where one end 11 and the other end 12 of the mobile terminal are fastened, the first antenna radiator 820 and the second antenna radiator 830 are electrically connected with each other and the second antenna radiator 830 is fed from the first antenna radiator 820 to resonate.

The second antenna radiator 830 may compensate for a mismatching resonant frequency of the first antenna radiator 820. That is, the second radiator 830 operates as an antenna matching unit for the first radiator 820 when the two ends 11, 12 are fastened. Furthermore, the second antenna radiator 830 may have a resonant frequency different from that of the first antenna radiator 820. A coupling unit 840 for electrically connecting the first antenna radiator 820 with the second antenna radiator 830 may include a male connector 840-1 and a female connector 840-2. The first and second antenna radiators 820, 830 may each be a monopole antenna as illustrated but each is not limited thereto and may be an inverted F antenna that is electrically connected to a grounding surface of the mainboard 810. The electrical connection between the two radiators is shown at the end portion of the radiator 820 but may be done at the center region or closer to the input region in other implementations.

Figure 9:
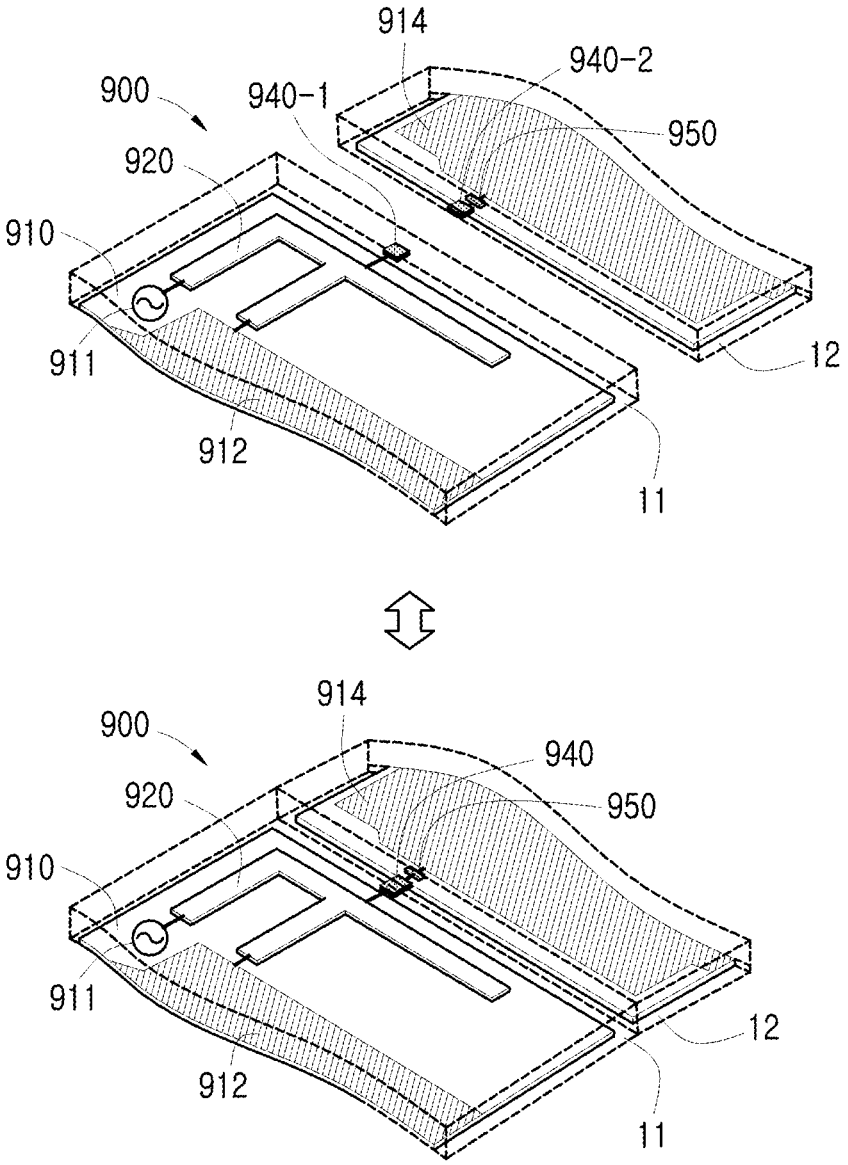
FIG. 9 is a view illustrating the configuration of an antenna apparatus according to a further exemplary embodiment of the present invention.

FIG. 9 is a view illustrating the configuration of an antenna apparatus, 900, according to a further exemplary embodiment of the present invention. Antenna apparatus 900 includes a first antenna radiator 920 fed from an RF feed port 911 of a mainboard 910 to resonate. Furthermore, a grounding surface 914 is electrically connected with the first antenna radiator 920 in the condition where one end 11 and the other end 12 of the mobile terminal are fastened. The grounding surface 914 may be included in the mainboard 910 or may be a surface of a different unit electrically connected to the mainboard 910, for example, a grounding surface of a sub board.

The feeding port 911 and a grounding surface 912 of the mainboard 910 are electrically connected with the first antenna radiator 920 at an input portion and a central portion, respectively. The first antenna radiator 920 is fed from the feeding port 911 to resonate as an inverted F antenna type. (Alternatively, the radiator 920 can be embodied as a monopole radiator; in this case, it would not include the illustrated stub connection to the ground surface 912. A monopole case is shown in FIG. 10.)

In the case where one end 11 and the other end 12 of the mobile terminal are fastened, the first antenna radiator 920 and the grounding surface 914 are electrically connected with each other, so that the first antenna radiator 920 may further configure an additional grounding surface for maintaining a desired or requisite antenna performance. For example, in the case where the mobile terminal bends, the antenna performance of the first antenna radiator 920 may deteriorate due to electromagnetic interference of the flexible display and other circuit components. For example, antenna efficiency and VSWR at operating frequencies may deteriorate due to the interference. To compensate for the interference, a stub connection to the grounding surface 914 through the coupling 940 is made, producing a reactance to tune the antenna radiator 920. Optionally, a matching circuit 950 is inserted between the coupling 940 and the ground surface 914 to further optimize the antenna radiator 920. Thus an antenna matching unit that changes the antenna 900 configuration is considered to comprise both the connection to the grounding surface 914 and the matching circuit 950 (or just the grounding surface connection if the matching circuit 950 is omitted).

Figure 10:
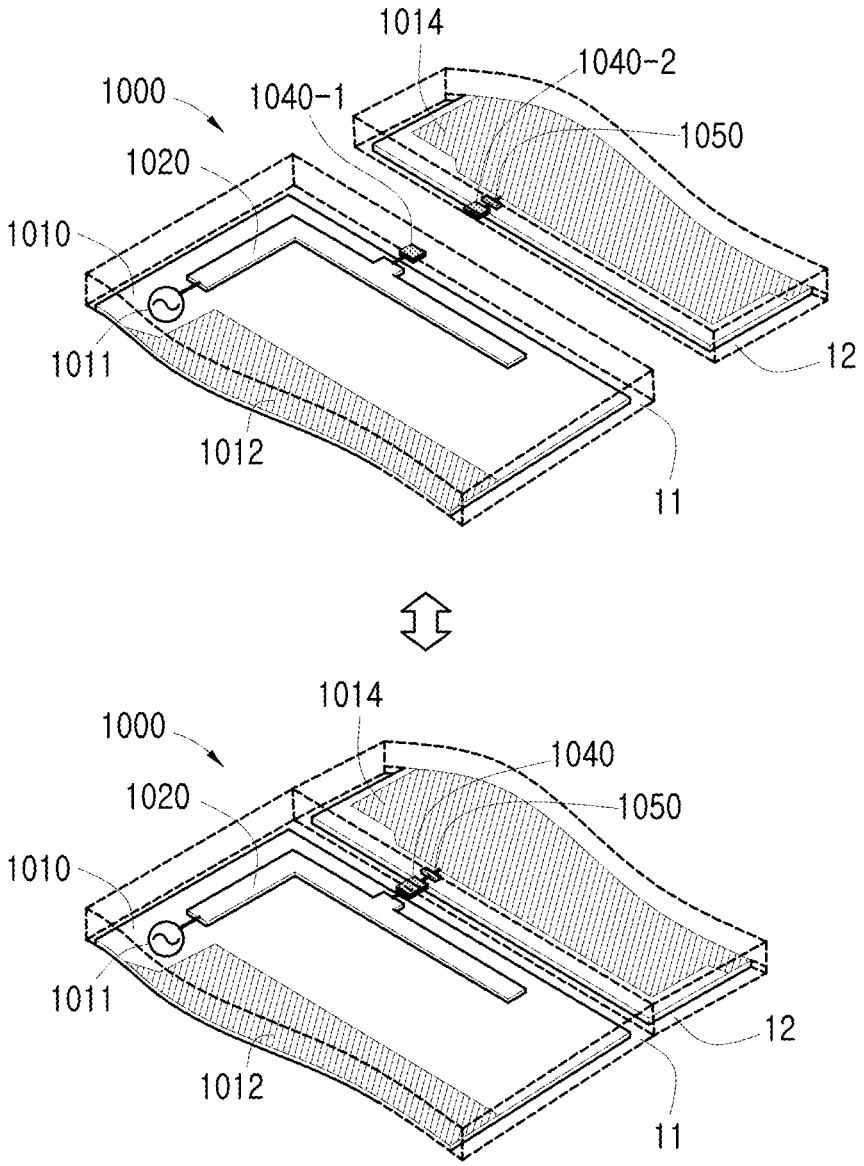
FIG. 10 is a view illustrating the configuration of an antenna apparatus according to another exemplary embodiment of the present invention.

FIG. 10 is a view illustrating the configuration of an antenna apparatus, 1000, according to another exemplary embodiment of the present invention. Antenna apparatus 1000 is similar to the apparatus 900 of FIG. 9, except a monopole radiator 1020 is used instead of the inverted F-type radiator 920, and the ensuing connection to a ground surface 1014 upon fastening effectively changes the configuration of the monopole to an inverted F.

In detail, the antenna apparatus 1000 includes a first antenna radiator 1020 fed from a mainboard 1010 to resonate. Furthermore, a grounding surface 1014 is electrically connected with the first antenna radiator 1020 in the case where one end 11 and the other end 12 of the mobile terminal are fastened. The grounding surface 1014 may be included in the mainboard 1010 or may include a different grounding surface connected to a grounding surface 1012 of the mainboard 1010.

A feeding portion 1011 of the mainboard 1010 and the first antenna radiator 1020 are electrically connected with each other. The first antenna radiator 1020 is fed from the feeding portion 1011 to resonate as a monopole antenna type.

In the case where one end 11 and the other end 12 of the mobile terminal are fastened, the first antenna radiator 1020 and the grounding surface 1014 are electrically connected, so that the first antenna radiator 1020 changes to an inverted F antenna type. In the case where the mobile terminal bends, the first antenna radiator 1020 changes from the monopole antenna type to the inverted F antenna type, thereby securing the antenna performance.

Figure 12:
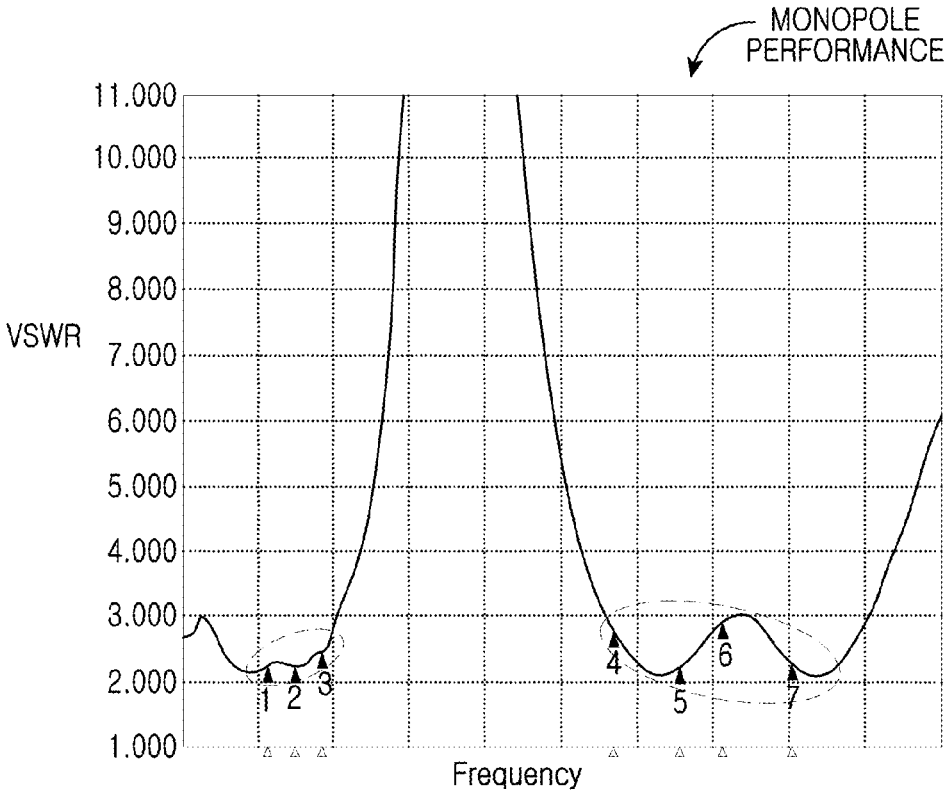
FIGS. 12 and 13 are graphs illustrating performance of an antenna according to an exemplary embodiment of the present invention corresponding to the configuration of FIG. 10.
Figure 13:
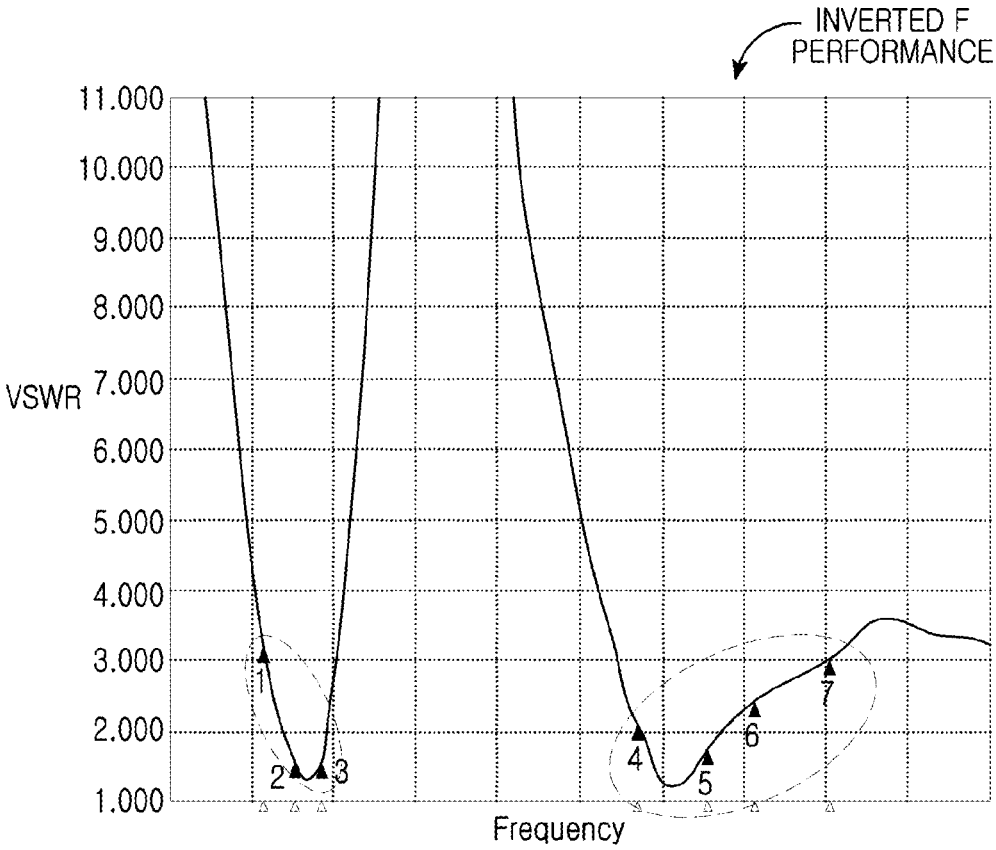

FIGS. 12 and 13 are graphs illustrating the performance (VSWR, S11) of an antenna according to an exemplary embodiment of the present invention corresponding to the configuration of FIG. 10. FIG. 12 illustrates a case where the antenna apparatus 1000 resonates as a monopole antenna type, i.e., while the ends 11 and 12 are in an unfastened state. FIG. 13 illustrates a case where the antenna apparatus 1000 resonates as an inverted F antenna type while the ends 11 and 12 are fastened. As shown, when the ends 11, 12 of mobile terminal 100 are fastened, representing a bent state of the terminal, the antenna apparatus 1000 changes from a monopole antenna type to an inverted F antenna type, and has a standing wave ratio of about 3 or less, that is, a return loss characteristic of −6 dB or better, whereby the antenna apparatus 1000 maintains an antenna performance required by the general mobile terminal. In the absence of the connection to the ground surface 1014, the performance of just the monopole antenna in the end 11 has been found to be unsatisfactory due to the interference with the flexible display; this problem is reduced or eliminated via the antenna configuration change, i.e., the conversion to the inverted F antenna as just described.

In the embodiments illustrated in FIGS. 6 through 10, the various antenna radiators are shown printed on the respective PCBs (mainboards). However, in alternative configurations of these embodiments, the radiators are formed as separate plates or as part of an FPCB as illustrated earlier in FIGS. 2 through 4.

Figure 11:
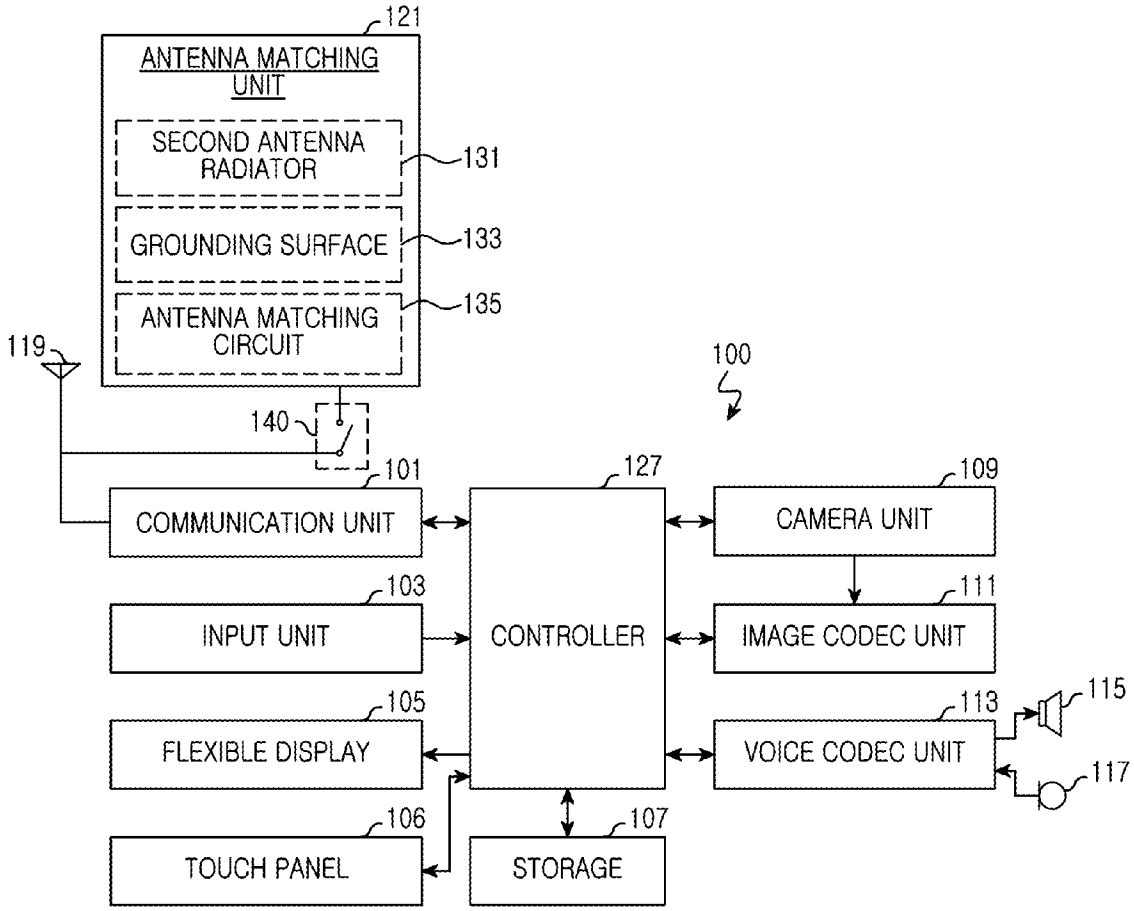
FIG. 11 is a functional block diagram illustrating a mobile terminal according to an exemplary embodiment of the present invention, which can incorporate any one of the antenna apparatus described in respective FIGS. 7-10.

FIG. 11 is a functional block diagram illustrating a mobile terminal according to an exemplary embodiment of the present invention, which can incorporate any one of the antenna apparatus 700, 800, 900 or 1000 described in respective FIGS. 7 through 10. In the following description, the description of elements already described in connection with FIG. 6B is omitted for brevity.

The embodiment of FIG. 11 differs from that of FIG. 6B as follows: instead of the controller 127 controlling the switching between antenna radiators on opposing ends 11 and 12 of the mobile terminal, a manual switch 140 is used to change the antenna configuration when the ends 11 and 12 are fastened. Switch 140 can be any one of the coupling units 740, 840, 940 or 1040 shown and described in reference to FIGS. 7 through 10. Accordingly, the switch 140 connects a first antenna radiator 119 (e.g., any one of radiators 720, 820, 920 or 1020) to an antenna matching unit 121 when the ends 11 and 12 are fastened via the respective coupling unit. The antenna matching unit 121 comprises at least one antenna modifying element, e.g., in the form of a second antenna radiator 131 (e.g., radiators 730 or 830), a grounding surface 133 (e.g., grounding surface 914 or 1014) and an antenna matching circuit 135 (e.g., matching circuits 750, 850, 950 or 1050).

Figure 14:
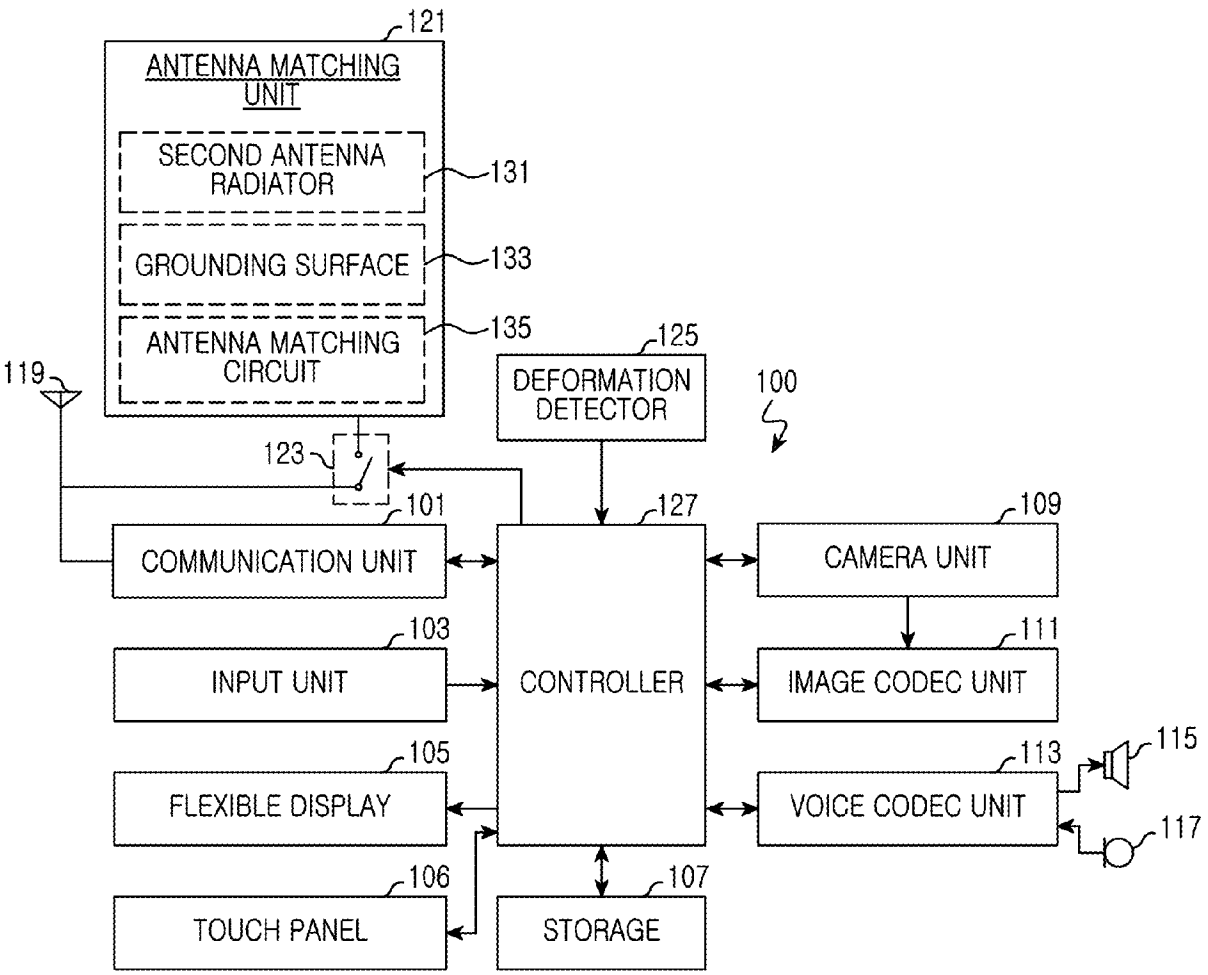
FIG. 14 is a functional block diagram illustrating a mobile terminal according to another exemplary embodiment of the present invention.

FIG. 14 is a functional block diagram illustrating a mobile terminal according to another exemplary embodiment of the present invention. This embodiment can incorporate a modified version of any one of the antenna apparatus 700, 800, 900 or 1000 described in respective FIGS. 7 through 10. In the following description, the description of elements already described in connection with FIG. 6B is omitted.

In the embodiment of FIG. 14, the manual switch 140 configured as the coupling units is replaced by a combination of a switch 123 and a deformation detector 125. Further, the controller 127 controls the connection of an antenna matching unit 121 to a first antenna radiator 119, e.g., any of the antenna radiators 720, 820, 920 or 1020 within the end 11, in accordance with deformation detection by detector 125. The antenna matching unit is at least one of second antenna radiator 131, grounding surface 133 and the antenna matching circuit 135. Each of these elements can be disposed in the opposing end 12 of the mobile terminal, or alternatively, in another portion of the mobile terminal 100.

The deformation detector 125 can be the same or similar to the deformation detector 650 described in connection with FIG. 6A. Deformation detector 125 may be integrated with the switch 123. For example, the switch 123 can be in the place of any of the coupling units 740, 840, 940 or 1040, while the deformation detector 125 is disposed in a different location.

The first antenna radiator 119 resonates and transmits/receives an RF signal.

The switching unit 123 connects or disconnects the first antenna radiator 119 with the antenna matching unit 121 under control of the controller 127. Furthermore, the switching unit 123 may also have configuration for connecting the first antenna radiator 119 with the antenna matching unit 121 even if one end and the other end of the mobile terminal are mechanically fastened. The switching unit 123 may include the coupling units 740 and 840.

The mobile terminal 100 of FIG. 14 can be configured to operate as follows: a plurality of antenna modifying elements (131, 133, 135) are electrically connectable to the first antenna radiator 119. The deformation detector 125 obtains deformation information of the mobile terminal. The controller 127 selects at least one of the plurality of antenna modifying elements based on the deformation information of the mobile terminal obtained by the deformation detector 125, and controls the switch 123 to electrically connect the at least one selected antenna modifying element to the antenna radiator 119.

The deformation detector 125 detects deformation of the mobile terminal 100 and informs the controller 127 of this deformation. The deformation detector 125 may be one of the following configurations. First, the deformation detector 125 includes a male connector on one end of the mobile terminal and a female connector on the other end of the mobile terminal. When the male connector and the female connector are electrically connected with each other, the deformation detector 125 provides a signal informing bending of the mobile terminal to the controller 127. Second, the deformation detector 125 includes a switch on one end of the mobile terminal and a member for turning on the switch on the other end of the mobile terminal. When the switch and the member are coupled to each other, the deformation detector 125 provides a signal informing bending of the mobile terminal to the controller 127. Third, the deformation detector 125 includes a sensor on one end of the mobile terminal and a member for the sensor on the other end of the mobile terminal. When the sensor reacts to the member for the sensor, the deformation detector 125 provides a signal informing bending of the mobile terminal to the controller 127.

The present invention is applicable not only to a mobile terminal that applies a flexible display but also to various electronic apparatuses that can perform wireless communication and can bend in shape. Furthermore, the present invention can change configuration of the antenna apparatus depending on a deformation type (for example, extension, shrinkage, warping, folding, twisting, bending, unfolding, etc.) and a deformation degree (size) of the mobile terminal.

Consequently, an antenna apparatus according to an exemplary embodiment of the present invention may change its configuration depending on deformation of a mobile terminal that applies a flexible display, to achieve a desired antenna performance.

The above-described processing operations performed by the controller can be implemented in hardware, firmware or as software or computer code that can be stored in a recording medium such as a CD ROM, an RAM, a floppy disk, a hard disk, or a magneto-optical disk or computer code downloaded over a network originally stored on a remote recording medium or a non-transitory machine readable medium and to be stored on a local recording medium, so that the operations described herein can be rendered in such software that is stored on the recording medium using a general purpose computer, or a special processor or in programmable or dedicated hardware, such as an ASIC or FPGA. As would be understood in the art, the computer, the processor, microprocessor controller or the programmable hardware includes memory components, e.g., RAM, ROM, Flash, etc. that may store or receive software or computer code that when accessed and executed by the computer, processor or hardware implement the processing methods described herein. In addition, it would be recognized that when a general purpose computer accesses code for implementing the processing shown herein, the execution of the code transforms the general purpose computer into a special purpose computer for executing the processing shown herein.

Although the invention has been shown and described with reference to certain exemplary embodiments thereof, it will be understood by those skilled in the art that various changes in form and details may be made therein without departing from the spirit and scope of the invention as defined by the appended claims and their equivalents. Therefore, the scope of the present invention should not be limited to the above-described embodiments but should be determined by not only the appended claims but also the equivalents thereof.

What is claimed is:

1. A mobile terminal comprising:

an antenna apparatus including:

an antenna radiator disposed at a first end of the mobile terminal;

at least one antenna modifying element disposed at a second, opposing end of the mobile terminal; and a coupling means for detachably physically fastening the first end of the mobile terminal with the antenna radiator disposed therein and the second end of the mobile terminal with the at least one antenna modifying element disposed therein and electrically connecting the at least one antenna modifying element with the antenna radiator when the first and second ends are fastened;

wherein the antenna modifying element changes an operational configuration of the antenna apparatus from one of:

a monopole antenna to an inverted F antenna;

an inverted F antenna connected at a point thereof to a ground surface, to an inverted F antenna connected at least at one additional point thereof to a ground surface;

a monopole or inverted F antenna having a first radiator to a monopole or inverted F antenna having at least one additional radiator; and a first part including a first monopole or inverted F radiator connected to a first signal source or receiver set to a first operating frequency, to a connected configuration of the first part with a second part that includes a second monopole or inverted F radiator connected to a second signal source or receiver set to a second operating frequency.

2. The mobile terminal of claim 1, wherein the at least one antenna modifying element comprises at least one of a second antenna radiator, a grounding surface, and an antenna matching circuit; and when the first and second ends are fastened, an entirety of the antenna apparatus is disposed only within a portion of the mobile terminal encompassed by the first and second ends.

3. The mobile terminal of claim 1, wherein:

when the first and second ends of the mobile terminal are fastened, the mobile terminal is deformed; and the antenna modifying element is a ground surface disposed in the second end.

4. The mobile terminal of claim 3, wherein:

the mobile terminal allows deformation of at least one of extension, shrinkage, warping, folding, twisting, bending, and unfolding;

the antenna apparatus resonates as the monopole antenna when the first and second ends are unfastened; and the antenna apparatus resonates as the inverted F antenna in a fastened state of the first and second ends, by means of a connection path from a point of the antenna radiator to the ground surface disposed in the second end.

5. The mobile terminal of claim 1, wherein the mobile terminal comprises a flexible display.

6. The mobile terminal of claim 1, wherein the mobile terminal comprises a touchscreen.

7. The mobile terminal of claim 1, wherein the antenna radiator is connected to a first feed port, providing a current, of a main board, and wherein the at least one antenna modifying element is connected to a second feed port, for providing a current, of the main board.

* * * * *